US009375068B2

(12) United States Patent
Koyama

(10) Patent No.: US 9,375,068 B2
(45) Date of Patent: Jun. 28, 2016

(54) CLICK-TYPE APPLICATOR

(75) Inventor: Hiroaki Koyama, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 676 days.

(21) Appl. No.: 13/581,891

(22) PCT Filed: Mar. 23, 2011

(86) PCT No.: PCT/JP2011/056986

§ 371 (c)(1),
(2), (4) Date: Aug. 30, 2012

(87) PCT Pub. No.: WO2011/118636

PCT Pub. Date: Sep. 29, 2011

(65) Prior Publication Data

US 2012/0328354 A1 Dec. 27, 2012

(30) Foreign Application Priority Data

Mar. 23, 2010 (JP) ..... 2010-066526
Mar. 23, 2010 (JP) ..... 2010-066527

(51) Int. Cl.
*A45D 34/04* (2006.01)
*B43K 5/06* (2006.01)
(Continued)

(52) U.S. Cl.
CPC . *A45D 34/04* (2013.01); *B43K 5/06* (2013.01); *B43K 8/02* (2013.01); *B43K 8/03* (2013.01); *B43L 19/0018* (2013.01); *B43L 19/0068* (2013.01); *A45D 2200/055* (2013.01)

(58) Field of Classification Search
CPC ..... B43K 1/084; B43K 7/12
USPC ..... 401/172–174, 179, 111, 209–218
See application file for complete search history.

(56) References Cited

U.S. PATENT DOCUMENTS 5,085,352 A * 2/1992 Sasaki et al. ..... 401/174
6,227,739 B1 5/2001 Kageyama
(Continued)

FOREIGN PATENT DOCUMENTS

JP 61-128082 U 8/1986
JP 2-142674 U 12/1990
(Continued)

OTHER PUBLICATIONS

International Search Report (PCT/ISA/210) issued on Jun. 14, 2011, by the Japanese Patent Office as the International Searching Authority for International Application No. PCT/JP2011/056986.
(Continued)

*Primary Examiner* — Jennifer C Chiang
*Assistant Examiner* — Bradley Oliver
(74) *Attorney, Agent, or Firm* — Buchanan, Ingersoll & Rooney PC

(57) ABSTRACT

In a click-type applicator, when the propelling element is moved forwards by a clicking operation, the advancing motion is transformed into a rotary motion of a transfer cam element in one direction by the function of guide slots of the propelling element and projected parts so that when a cam portion of transfer cam element meshes with a cam portion at the rear of a rotary cam element, the rotation of the transfer cam element causes rotary cam element to rotate and thereby move the screw shaft and hence a piston forwards. On the other hand, by releasing the clicking operation, propelling element is moved backwards due to the repulsive force of a spring, and the backward motion is transformed into a rotary motion of transfer cam element in the other direction by the function of the guide slots and projected parts so as to restore the original position.

9 Claims, 8 Drawing Sheets

(51) Int. Cl.

| | |
|---|---|
| ***B43K 8/02*** | (2006.01) |
| ***B43K 8/03*** | (2006.01) |
| ***B43L 19/00*** | (2006.01) |

(56) References Cited

U.S. PATENT DOCUMENTS

| | | | | |
|---|---|---|---|---|
| 8,845,221 | B2 * | 9/2014 | Fukumoto | A45D 34/04 401/171 |
| 2002/0070247 | A1 * | 6/2002 | Kageyama et al. | 401/171 |
| 2005/0158114 | A1 | 7/2005 | Noguchi | |
| 2010/0104347 | A1 * | 4/2010 | Furukawa et al. | 401/99 |
| 2010/0139677 | A1 * | 6/2010 | Tsai | A45D 29/12 401/172 |
| 2012/0128402 | A1 * | 5/2012 | Wightman | A45D 34/042 401/172 |

FOREIGN PATENT DOCUMENTS

| | | | |
|---|---|---|---|
| JP | 2001-232273 | A | 8/2001 |
| JP | 2001-299442 | A | 10/2001 |
| JP | 2005-206165 | A | 8/2005 |
| JP | 2008-179000 | A | 8/2008 |
| WO | WO 2009/125868 | A1 | 10/2009 |

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) dated Oct. 26, 2012, in the International Application No. PCT/JP2011/056986. ( 8 pages).

* cited by examiner 12
14
16
18
18b
18c
20
20a
20b
20c
34

22c 22c
22b2

22a
22b3

22a1
A
A
22a
22c
22b

22a1
22a2
22b3
22b1

22b

22a1
22c
22b
22b3
22b2
22b1

22b1
22b3
22b
22b2

22a
22
22b
22b3

CLICK-TYPE APPLICATOR

TECHNICAL FIELD

The present invention relates to a click-type applicator that is operated by clicking to propel and supply a fluid content such as liquid cosmetics, correction liquid, ink, etc., in particular, high-viscosity cosmetic fluid, to an applying part.

BACKGROUND ART

Conventionally, in click-type propelling containers such as click-type cosmetics, click-type writing implements and the like, a content is stored in a reservoir inside a barrel cylinder and the content is propelled when the user clicks the container. Upon propelling, a clicking part arranged at the rear end of the barrel cylinder is clicked to advance a screw rod via cam elements and move the piston at the front end of the screw rod forwards, whereby the aforementioned content is delivered to the applying part.

Concerning click-type applicators, for instance, Japanese Patent Application Laid-open 2001-232273 (Patent Document 1) discloses such a configuration that a click part is pushed to rotate a click cam along an inclined groove so that rotation of the click cam turns a screw rod via a rotary cam. Then a piston provided at the front end of the screw rod is moved forwards inside a tank so as to push out the liquid inside the tank to an applying part at the tip.

Japanese Patent Application Laid-open 2005-206165 (Patent Document 2) discloses a configuration which includes a cartridge removably mounted to the main part and an actuator for pushing out a piston inside the cartridge forwards and which is constructed such that the piston is arranged at the front end of a screw rod fitted in a female screw on the inner surface of a chuck, and when the screw rod is rotated and moved forwards by rotation of the actuator, the piston is advanced to thereby send out a content.

International Publication WO/2009/125868 (Patent Document 3) discloses a configuration which includes a mechanism that converts the force acting on a crown to a rotational force, a screw element fixed to a barrel body and a screw rod fit with the screw element and which is constructed such that the rotational force (rotational force of the cam) converted by the aforementioned mechanism moves the screw rod forwards via the screw element to thereby deliver the content inside a reservoir by a piston.

Japanese Patent Application Laid-open 2008-179000 (Patent Document 4) discloses a writing implement having a click mechanism, in which a damper space that is confined from the outside and changed in volume by a pushing operation at a click part is provided between the interior of the click part and a barrel cylinder, so as to realize impact absorbing effect without disturbing normal operation.

PRIOR ART DOCUMENTS

Patent Documents

Patent Document 1:
Japanese Patent Application Laid-open 2001-232273
Patent Document 2:
Japanese Patent Application Laid-open 2005-206165
Patent Document 3:
International Publication WO2009/125868
Patent Document 4:
Japanese Patent Application Laid-open 2008-179000

SUMMARY OF THE INVENTION

Problems to be Solved by the Invention

However, there has been a demand for a configuration which can click, when propelling a high-viscosity content, with a lighter operational feeling while preventing the loss of clicking force and which can be easily manufactured with a reduced number of parts. However, there has been no conventional product to fulfill this demand. Further, since when the threaded part is formed (by injection molding, etc.), a rotational core is needed for molding, the mold becomes complicated. Further, since the front end of the core has to be formed with cutting tool-like sharp-edges, there is a risk of molding trouble occurring such as the front end of the core being broken during manufacturing. Together with this, there have been demands for reduction of the number of parts and improvement of operativity in assembling and the like at the time of manufacturing.

In view of the above circumstances, it is an object of the present invention to provide a click-type applicator which can click, when delivering a high-viscosity content, with a lighter operational feeling while preventing the loss of clicking force and which can be easily manufactured with a reduced number of parts.

Means for Solving the Problems

The present invention resides in a click-type applicator storing an application liquid in a barrel cylinder, wherein a screw shaft having a male thread on the peripheral side thereof is engaged with the rear part of a piston that slides inside the barrel cylinder, the piston is advanced by means of the screw shaft by a propelling operation on a propelling mechanism so as to supply the application liquid inside the barrel cylinder to an applying part at the front end of the barrel cylinder, characterized in that the propelling mechanism comprises:

a rotary cam element having cam portions formed in the front and rear thereof;

a transfer cam element having a cam portion at the front thereof to mesh a cam portion at the rear of the rotary cam element and having a projected part formed on the side surface thereof;

a propelling element, in which a guide slot that guides the projected part of the transfer cam element is formed inclined relative to the axial direction, and which is restrained from rotating relative to the barrel cylinder;

a spring that urges the propelling element backwards and urges the transfer cam element forwards; and, a fixed cam element formed with a backward-facing cam portion and restrained from rotating relative to the barrel cylinder, one of the rotary cam element and the fixed cam element is formed with an engagement structure that is restrained from rotating relative to the screw shaft while the other is formed with a threaded part that mates with the screw shaft so that rotation of the rotary cam element is transformed into a motion that advances the screw shaft relative to the barrel cylinder by the function of cooperation of the engagement structure, the threaded part and the screw shaft, so as to advance the piston, when the propelling element is moved forwards by a clicking operation, the advancing motion is transformed into a rotary motion of the transfer cam element in one direction by the function of the guide slot and projected part so that when the cam portion of the transfer cam element meshes with the cam portion at the rear of the rotary cam element, the rotation of the transfer cam element causes the rotary cam element to rotate and thereby move the screw shaft and hence the piston forwards, and, when the clicking operation is released after the propelling element has been once advanced by the clicking operation, the propelling element moves backwards due to the repulsive force of the spring, and the backward motion of the propelling element is transformed into a rotary motion of the transfer cam element in the other direction by the function of the guide slot and the projected part so as to restore the original position while the cam portion at the front of the rotary cam element meshes with the cam portion of the fixed cam element, whereby the rotary motion of the rotary cam element is restrained and hence the operational actions of the screw shaft and the piston are restrained.

In the present invention, it is preferred that a sleeve portion that is extended backwards from the rear part of the fixed cam element in such a manner as to enclose the cam portion, has the rotary cam element, the transfer cam element, the propelling element and the spring, arranged therein.

In the present invention, it is preferred that the screw shaft has a variant shape from which part of the periphery is cut away in a cross-sectional view, the rotary cam element is formed with a variant hole that passes the screw shaft therethrough so as to allow the axial movement, and restrain the relative rotation, of the screw shaft, the cam portion of the transfer cam element and the backward-facing cam portion of the rotary cam element are formed with saw-toothed shapes so that, upon the abutment state between each other, the cam portions will mesh with each other when the transfer cam element turns in one direction and will easily release one from the other when the transfer cam element turns in the other direction, the fixed cam element is so formed that a female screw that mates with a male thread of the screw shaft is formed in the center axis thereof and the forward-facing cam portion of the rotary cam element is arranged opposing the backward-facing cam portion thereof, the forward-facing cam portion of the rotary cam element and the backward-facing cam portion of the fixed cam element are formed with saw-toothed shapes so that, upon the abutment state between each other, the cam portions will mesh with each other when the rotary cam element turns in the other direction and will easily release one from the other when the rotary cam element turns in one direction, the propelling element is arranged so as to be axially movable within a fixed range with its relative rotation to the fixed cam element restrained, when the propelling element is pressed forwards, the propelling element moves forwards opposing the repulsive force of the spring, which causes the projected part to slide along the guide slot so that the transfer cam element rotates in one direction, as the transfer cam element turns in one direction, the cam portions of the transfer cam element and the rotary cam element abutting each other mesh with one another while engagement between the forward-facing cam portion of the rotary cam element and the backward-facing cam portion of the fixed cam element is released from each other, whereby rotation of the transfer cam element is transferred to the rotary cam element, which causes the screw shaft to rotate and advance by the function of the female screw of the fixed cam element, when the pushing operation of the propelling element is released, the propelling element moves backwards by the repulsive force of the spring, whereby the projected part moves along the guide slot and the transfer cam element rotates in the opposite direction, and engagement of teeth between the cam portions of the transfer cam element and the rotary cam element abutting each other is released while the forward-facing cam portion of the rotary cam element and the backward-facing cam portion of the fixed cam element become engaged with each other, whereby rotation of the transfer cam element in the opposite direction will not be transferred to the rotary cam element.

In the present invention, it is preferred that the screw shaft has a variant shape from which part of the periphery is cut away in a cross-sectional view, the rotary cam element is formed with a variant hole that passes the screw shaft therethrough so as to allow the axial movement, and restrain the relative rotation, of the screw shaft, the fixed cam element is approximately cylindrical and has a front part, projected forward and having a female screw that mates with the male thread of the screw shaft, formed in the center axis, and, the female screw portion is formed with cutout from the front end to the rear so that the female screw portion will elastically deform and become larger in diameter as a whole, so as to spread due to the cutout when the screw shaft is attached thereto.

In the present invention, it is preferred that the guide slot of the propelling element is formed such that the rotatable range of the transfer cam element in a circumferential direction, limited by engagement of the projection with the guide slot, is greater than each of the tooth pitch of the transfer cam element and the backward-facing cam portion of the rotary cam element and the tooth pitch of the cam portions of the forward-facing cam portion of the rotary cam element and the backward-facing cam portion of the fixed cam element.

In the present invention, it is preferred that the tooth pitch of the cam portion of the transfer cam element and the backward-facing cam portion of the rotary cam element is equal to the tooth pitch of the cam portion of the forward-facing cam portion of the rotary cam element and the backward-facing cam portion of the fixed cam element while the teeth of the backward-facing cam portion and the teeth of the forward-facing cam portion of the rotary cam element are out of phase.

In the present invention, it is preferred that an annular elastic member is disposed circumferentially between the outer periphery of the propelling element and the inner periphery of the sleeve portion of the fixed cam element.

Also, another aspect of the present invention resides in a click-type applicator incorporating a reservoir for storing an application liquid, a piston that slides inside the reservoir and a screw shaft having a male thread formed on the peripheral surface thereof, in a barrel cylinder so as to supply the application liquid from the reservoir to an applying part at the front end of the barrel cylinder, including: in the rear of the reservoir of the barrel cylinder, a rotary cam element restrained from rotating relative to the screw shaft;

a transfer element disposed at the rear end for rotating the rotary cam element by operating the propelling element; and a screw element formed with a threaded part mating with the screw shaft, characterized in that the threaded part of the screw element has a structure that is elastically deformable in radial direction and can be spread with respect to a parting line, and the application liquid stored in the reservoir is supplied to the applying part by propelling the piston as the rotary cam element is rotated by actuating the propelling element.

In the present invention, it is also preferred that the screw element has a threaded part on the front end side thereof with fin-like vanes on the outer peripheral surface of the threaded part and also has a sleeve portion in the rear of the threaded part, and the sleeve portion accommodates the rotary cam element, transfer element, propelling element and screw shaft therein, and the screw shaft is mated with the female screw thread inside the threaded part.

Further, in the present invention, it is preferred that the screw element has a cam portion directed backwards inside the sleeve portion in the rear of the threaded part, and a forward-facing cam portion of the rotary cam element is arranged opposing the backward-facing cam portion, and, the forward-facing cam portion of the rotary cam element and the backward-facing cam portion inside the sleeve portion of the screw element are formed with saw-toothed shapes so that, upon the abutment state between each other, the cam portions will mesh with each other when the rotary cam element turns in the other direction and will easily release one from the other when the rotary cam element turns in one direction.

Effect of the Invention

According to the click-type applicator of the present invention, in the propelling mechanism, the guide slot of the propelling element is formed tilted or angled relative to the axial direction, and when the propelling element is moved forwards by a clicking operation, the advancing motion is transformed into a rotary motion of the transfer cam element in one direction by the function of the guide slot and projected part so that when the cam portion of the transfer cam element meshes with the cam portion at the rear of the rotary cam element, the rotation of the transfer cam element causes the rotary cam element to rotate and thereby move the screw shaft and hence the piston forwards, and, when the clicking operation is released after the propelling element has been once advanced by the clicking operation, the propelling element moves backwards due to the repulsive force of the spring, and the backward motion of the propelling element is transformed into a rotary motion of the transfer cam element in the other direction by the function of the guide slot and the projected part so as to restore the original position while the cam portion at the front of the rotary cam element meshes with the cam portion of the fixed cam element, whereby the rotary motion of the rotary cam element is restrained and hence the operational actions of the screw shaft and the piston are restrained. Accordingly, the force of the clicking operation of the propelling element can be transferred to the pressing force of the piston without any loss, and hence it is possible to make the operating sensation lighter while preventing the loss of clicking force when a high-viscosity content is propelled.

In addition, since the fixed cam element has a backward-facing cam portion integrally formed in the rear part thereof, or because no separate cam element is provided, it is possible to reduce the number of parts and facilitate manufacturing, compared to the conventional products using a separate cam element (e.g., Japanese Patent Application Laid-open 2001-232273).

Here, a sleeve portion is extended backwards from the rear part of the fixed cam element in such a manner as to enclose the cam portion, and adapted to have the rotary cam element, the transfer cam element, the propelling element and the spring, arranged therein, whereby it is possible to achieve compact integration and ease of sub-assembly by the integration, hence these parts can be easily sub-assembled and inserted into the barrel cylinder, thus making it possible to facilitate manufacturing and positively achieve reduction in production cost.

Further, when the propelling element is pressed forwards, the propelling element moves forwards opposing the repulsive force of the spring, which causes the projected part to slide along the guide slot so that the transfer cam element rotates in one direction, as the transfer cam element turns in one direction, the cam portions of the transfer cam element and the rotary cam element abutting each other mesh with one another while engagement between the forward-facing cam portion of the rotary cam element and the backward-facing cam portion of the fixed cam element is released from each other, whereby rotation of the transfer cam element is transferred to the rotary cam element, which causes the screw shaft to rotate and advance by the function of the female screw of the fixed cam element, when the pushing operation of the propelling element is released, the propelling element moves backwards by the repulsive force of the spring, whereby the projected part moves along the guide slot and the transfer cam element rotates in the opposite direction, and engagement of teeth between the cam portions of the transfer cam element and the rotary cam element abutting each other is released while the forward-facing cam portion of the rotary cam element and the backward-facing cam portion of the fixed cam element become engaged with each other, whereby rotation of the transfer cam element in the opposite direction will not be transferred to the rotary cam element. This configuration makes it possible to push out the piston smoothly as pushing operations (clicking operations) of the propelling element are repeated.

When the present invention is configured such that the screw shaft has a variant shape from which part of the periphery is cut away in a cross-sectional view, the rotary cam element is formed with a variant hole that passes the screw shaft therethrough so as to allow the axial movement, and restrain the relative rotation, of the screw shaft, the fixed cam element is approximately cylindrical and has a front part, projected forward and having a female screw that mates with the male thread of the screw shaft, formed in the center axis, and, the female screw portion is formed with cutout from the front end to the rear so that the female screw portion will elastically deform and become larger in diameter as a whole, so as to spread due to the cutout when the screw shaft is attached thereto, the screw shaft can be assembled without the need to turn the screw shaft into the female screw part, hence this enables easy and reliable attachment in the manufacturing line and can alleviate work load in a remarkable manner.

Further, in the present invention, when the tooth pitch of the transfer cam element and the backward-facing cam portion of the rotary cam element and the tooth pitch of the forward-facing cam portion of the rotary cam portion and the backward-facing cam portion inside the fixed cam element are made equal to each other while the teeth of the backward-facing cam portion and the teeth of the forward-facing cam portion of the rotary cam element are formed out of phase, the cam teeth of the rotary cam element are fitted in the cam teeth of the sleeve portion before clicking operation of the propelling element while the teeth of the cam portion of the transfer cam element and the teeth of the backward-facing cam portion of the rotary cam element are out of phase, so that the transfer cam element rotates as the propelling element moves forwards. Then, when the clicking of the propelling element is released, the rotary cam and the cam portions reliably mesh each other, it is possible to reliably prevent the rotary cam from rotating in reverse.

Further, in the present invention, when an elastic annular seal member is circumferentially inserted between the outer periphery of the propelling element and the inner periphery of the sleeve portion of the fixed cam element, the annular elastic member can assure airtightness from the propelling element to the rear, reliably prevent the content from drying and being deteriorated and produce other excellent effect.

Further, according to the present invention, the applicator includes: in the rear of the reservoir of the barrel cylinder, a rotary cam element restrained from rotating relative to the screw shaft; a transfer element disposed at the rear end for rotating the rotary cam element by operating the propelling element; and a screw element formed with a threaded part mating with the screw shaft, and is constructed such that the threaded part of the screw element has a structure that is elastically deformable in radial direction and can be spread with respect to a parting line, and the application liquid stored in the reservoir is supplied to the applying part by propelling the piston as the rotary cam element is rotated by actuating the propelling element. Accordingly, in the production process of assembling the screw shaft to the screw element, the screw element spreads when the screw shaft is pushed into the threaded part of the screw element, so that the screw shaft can be attached directly. Hence it is possible to omit screw-fitting work and hence reduce the time of the production process.

On the other hand, in the molded part of the conventional threaded part, the threaded part is formed (by injection molding or the like) without forming any parting line, so that the mold needs a rotary core for forming, resulting in being complicated, and there is no other way than making the tip of the core have a pointed blade-like sharp edge, hence there is a risk of molding trouble and the like occurring such as the tip of the core is broken during production. In contrast, since the screw element of the invention has such a structure that the threaded part of the screw element can elastically deform and radially open from the parting line, it is possible to pull out the metal core after molding the threaded part without using any rotary core, hence positively avoid the aforementioned molding trouble.

Here, the above-described screw element has the threaded part formed on the front end side with fin-like vanes on the outer peripheral surface of the threaded part and also has the sleeve portion in the rear of the threaded part, which accommodates the rotary cam element, transfer element, propelling element and screw shaft therein. By mating the screw shaft with the female screw inside the threaded part, whereby it is possible to move the screw shaft forwards and backwards by rotation of the screw element. Further, it is possible to achieve compact integration and ease of sub-assembly by building the transfer element, rotary cam element, screw shaft and propelling element into the sleeve of the screw element, hence these parts can be sub-assembled and inserted into the barrel cylinder, thus making it possible to facilitate manufacturing and positively achieve reduction in production cost.

Further, when the screw element has a cam portion directed backwards inside the sleeve portion in the rear of the threaded part, and a forward-facing cam portion of the rotary cam element is arranged opposing the backward-facing cam portion, and the forward-facing cam portion of the rotary cam element and the backward-facing cam portion inside the sleeve portion of the screw element are formed with saw-toothed shapes so that, upon the abutment state between each other, the cam portions will mesh with each other when the rotary cam element turns in the other direction and will easily release one from the other when the rotary cam element turns in one direction, it is possible to positively fix the rotary direction of the rotary cam element in one direction.

In addition, since the sleeve portion having the backward-facing cam portion integrally formed therein is provided as the rear part of the screw element, or because no separate cam element is provided, it is possible to achieve excellent effect such as reducing the number of parts and facilitating manufacturing, compared to the conventional products using a separate cam element (e.g., Japanese Patent Application Laid-open 2001-232273).

MODE FOR CARRYING OUT THE INVENTION

Figure 1:
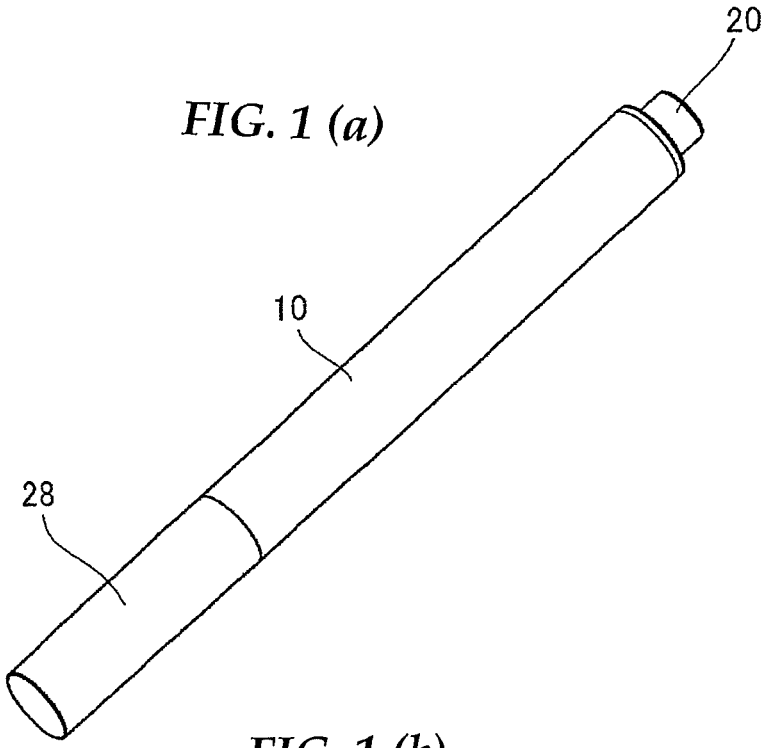
FIG. 1 is an overall view showing an applicator according to the embodiment of the present invention with a cap fitted thereon, (a) a perspective view and (*b*) a side view.
Figure 1:
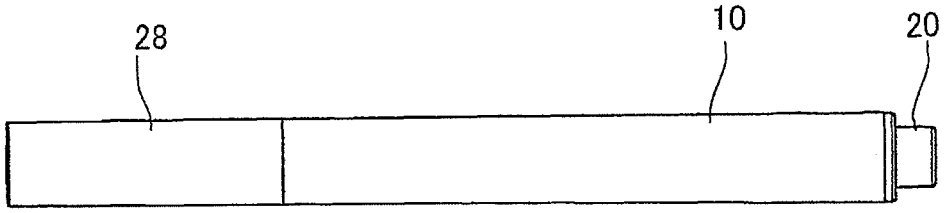

Next, the embodiment of the present invention will be described with reference to the accompanying drawings.

FIGS. 1 to 8 are illustrative diagrams of an applicator according to the embodiment of the present invention, and in the drawings, those allotted with the same reference numerals represent the same components.

Figure 2:
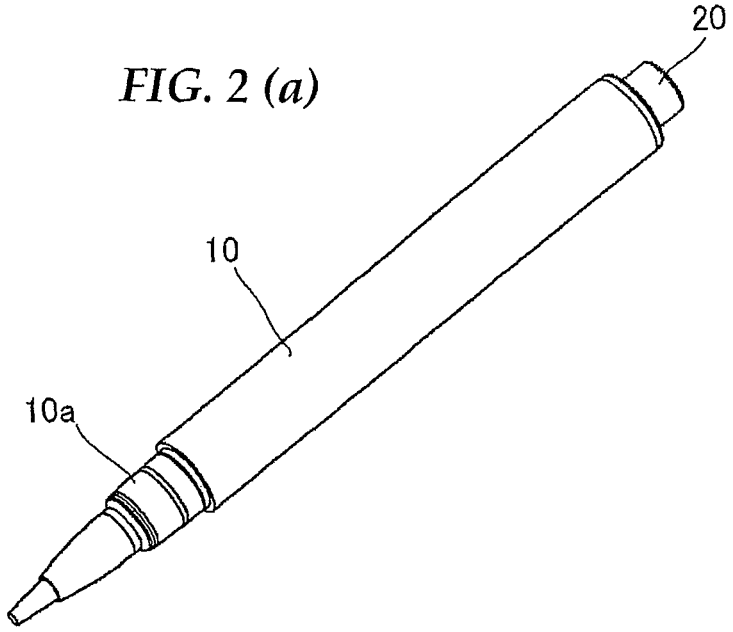
FIG. 2 is an overall view showing the applicator in FIG. 1 with the cap removed, (*a*) a perspective view and (*b*) a side view.
Figure 2:
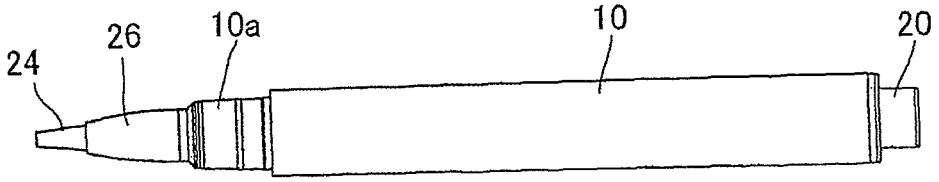
Figure 3:
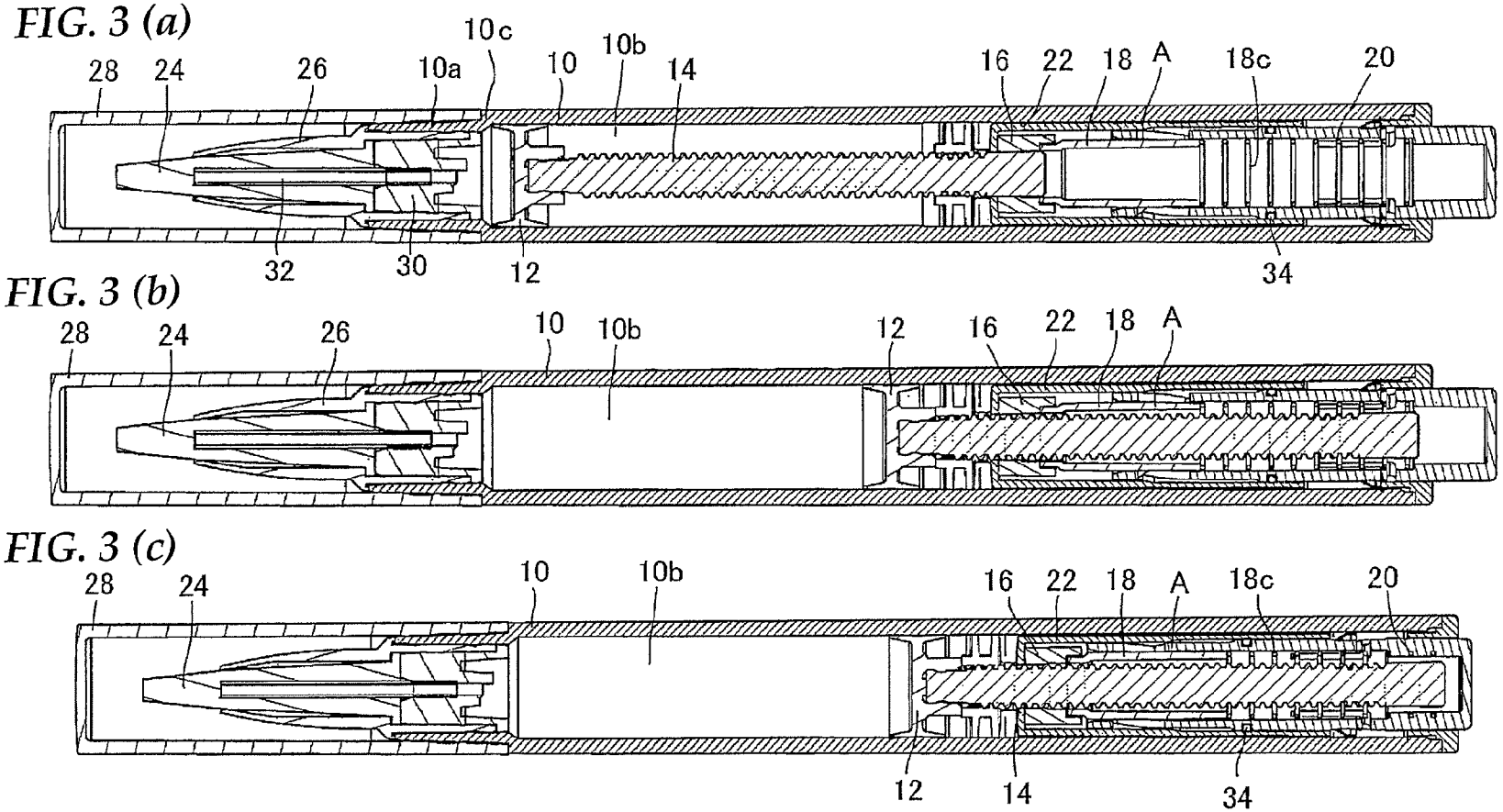
FIG. 3 is an overall vertical sectional view for illustrating operation actions of the same applicator, (*a*) a state in which a piston has been advanced to the limit (a state in which delivery of application is completed), (*b*) a state in which a propelling element is not clicked (normal mode), (*c*) a state in which the propelling element is clicked.
Figure 4:
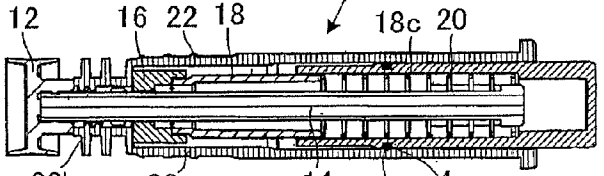
FIG. 4 is an illustrative view showing a propelling mechanism of the same applicator, in which a piston, screw element, screw shaft, rotary cam element, transfer cam element, spring and propelling element are sub-assembled, (*a*) a perspective view, viewed from one side, (*b*) a perspective view, viewed from the other side, (*c*) a vertical sectional view of the state (*a*), (*d*) a side view of the same state, (*e*) a vertical sectional view of the state (b) and (f) a side view of the same state.
Figure 4:
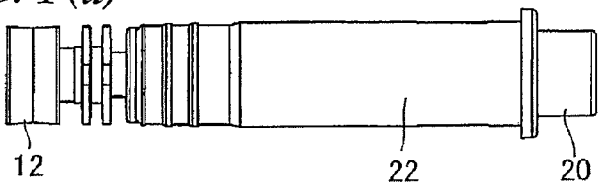
Figure 4:
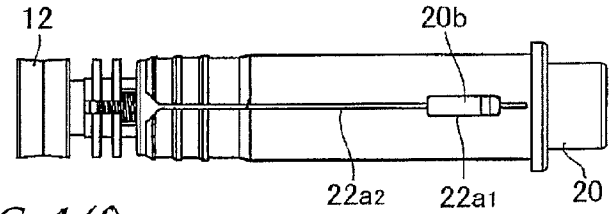
Figure 4:
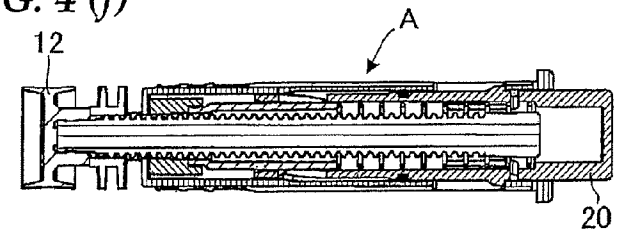
Figure 4:
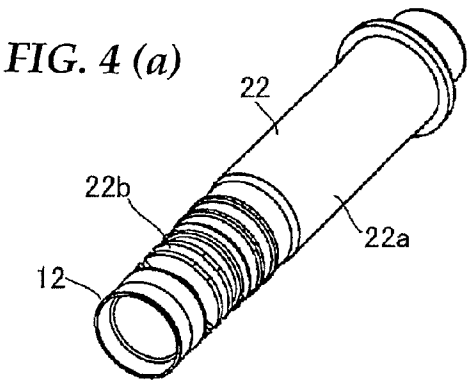
Figure 4:
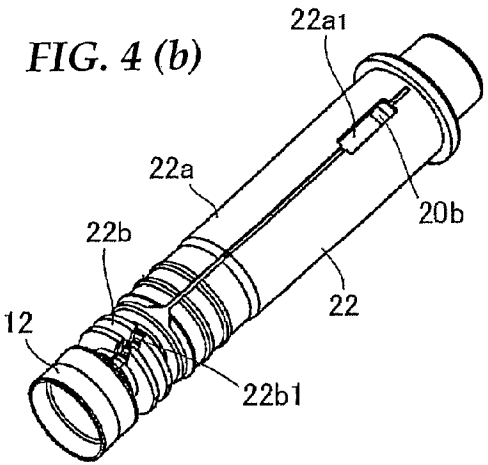
Figure 5:
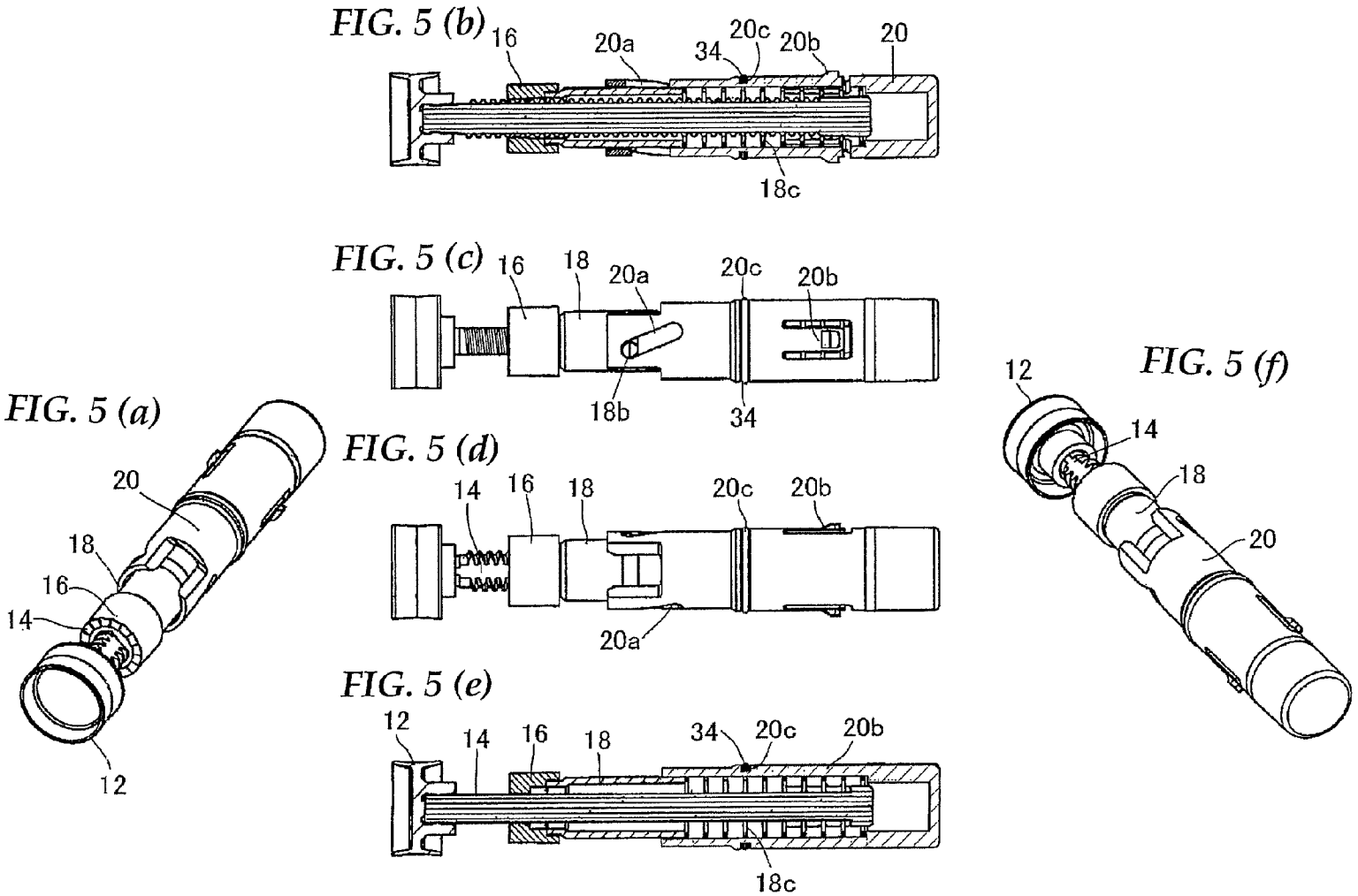
FIG. 5 is an illustrative view showing the propelling mechanism of the same applicator, in which the screw shaft (with the screw element removed from the state of FIG. 4), rotary cam element, transfer cam element, spring and propelling element are sub-assembled, (*a*) a perspective view, viewed from the front side, (*b*) a vertical sectional view (*c*) a side view 90° rotated, (*d*) a side view further rotated by 90°, (*e*) a vertical sectional view of the state (*d*), and (*f*) a perspective view, viewed from the rear side.
Figure 6:
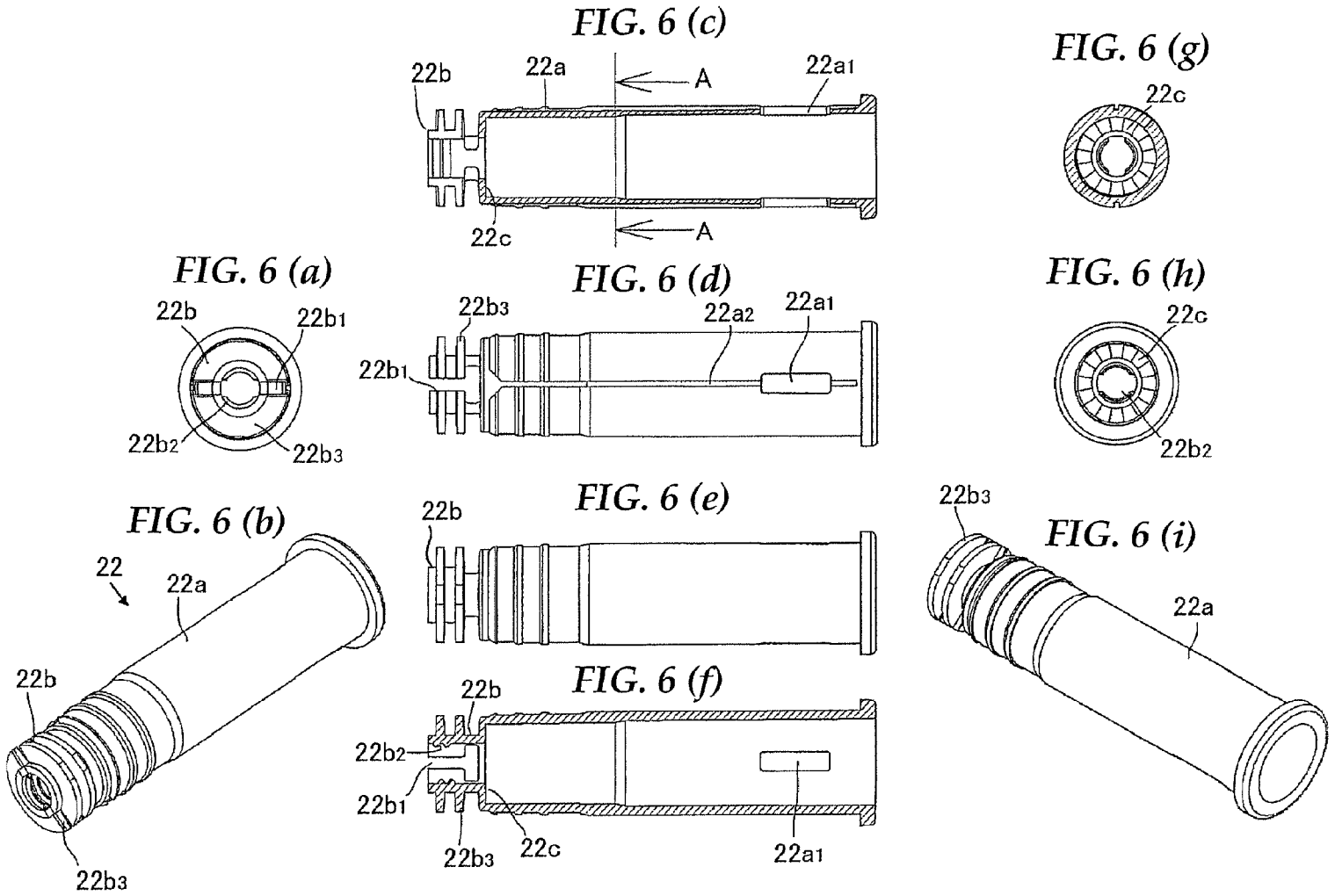
FIG. 6 is an illustrative view showing the screw element in the propelling mechanism of the same applicator, (*a*) a front view, (*b*) a perspective view, viewed from the front side, (*c*) a vertical sectional view, (d) a side view 90° rotated, (*e*) a side view further rotated by 90°, (*f*) a vertical sectional view of the state (*d*), and (*g*) a rear view, (*h*) a sectional view cut along a line A-A in (*c*) and (*i*) a perspective view, viewed from the rear side.
Figure 7:
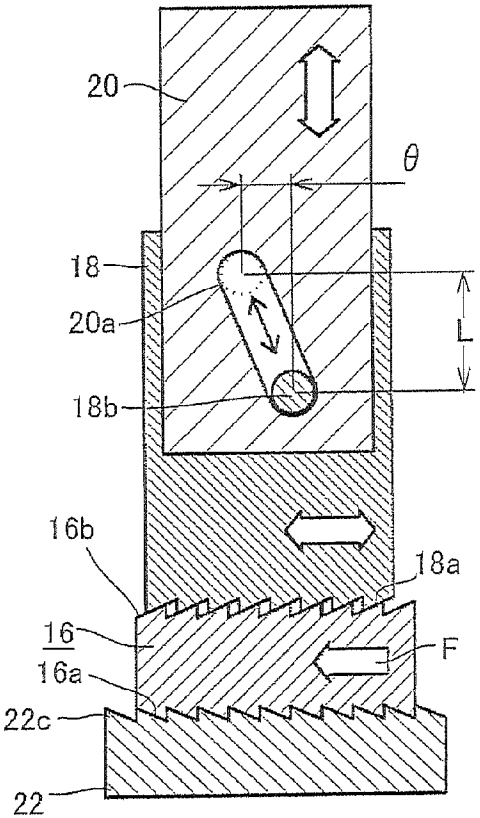
FIG. 7 is an operational illustrative view for illustrating the cam actions in the propelling mechanism of the same applicator based on schematic diagrams of the screw element, rotary cam element, transfer cam element and propelling element, (*a*) an illustrative diagram of individual parts, (*b*) a diagram of the initial state and (*c*) a diagram of the state at start of clicking.
Figure 7:
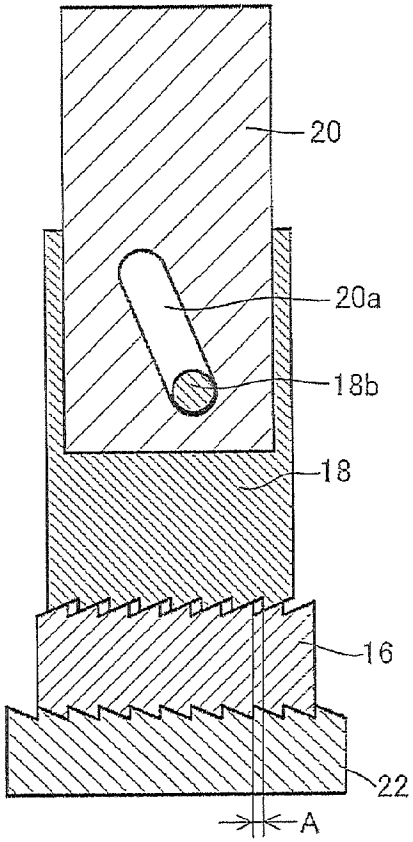
Figure 7:
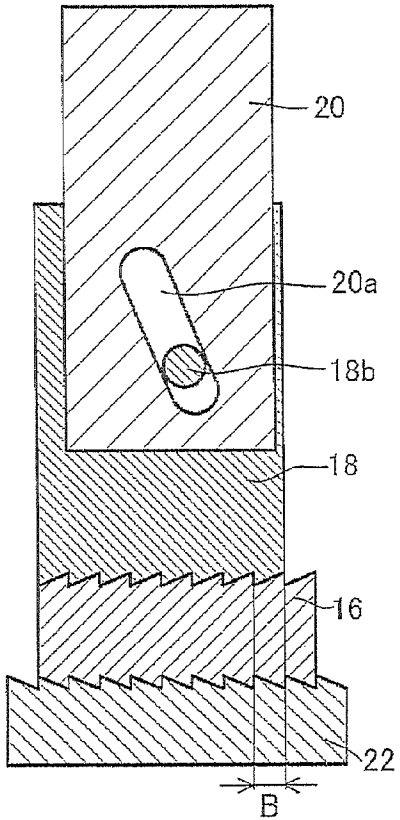
Figure 8:
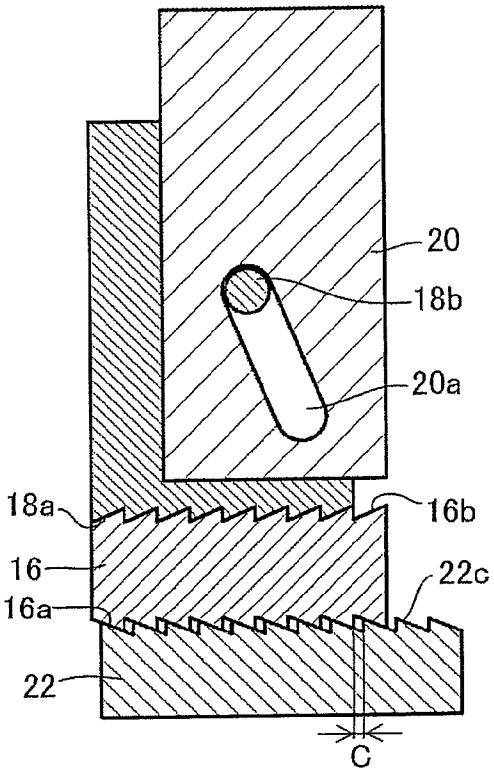
FIG. 8 is an operational illustrative view for illustrating the cam actions in the propelling mechanism of the same applicator, following FIG. 7, (*a*) a diagram of a state of the mechanism when fully clicked, (*b*) a diagram of a state when clicking is released and starts to return and (*c*) a diagram of a state in which the initial state is restored after clicking has completely returned.
Figure 8:
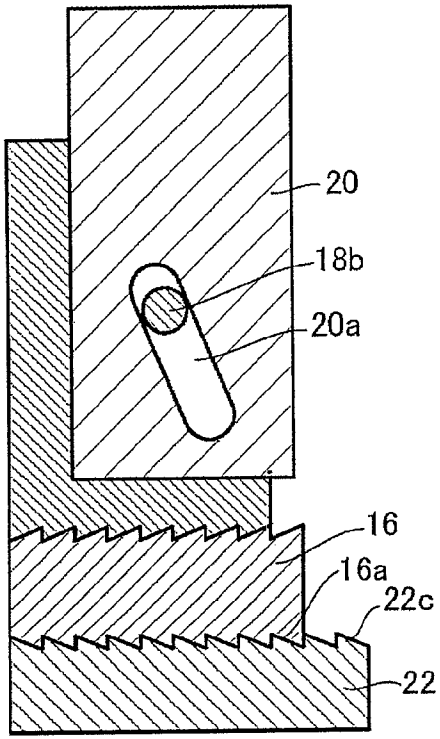
Figure 8:
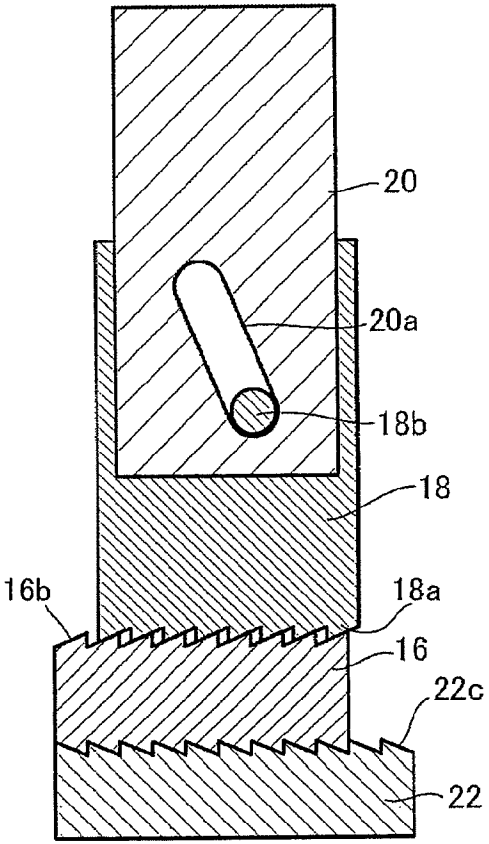

FIG. 1 is an overall view showing a state of an applicator of the embodiment of the present invention with a cap fitted thereon; FIG. 2 is an overall view showing the same applicator with the cap removed; FIG. 3 is an overall vertical sectional view for illustrating operational actions of the same applicator; FIG. 4 is an illustrative view showing a propelling mechanism of the same applicator, in which a piston, screw element, screw shaft, rotary cam element, transfer cam element, spring and propelling element are sub-assembled; FIG. 5 is an illustrative view showing the propelling mechanism of the same applicator, in which the screw shaft (with the screw element removed from the state of FIG. 4), rotary cam element, transfer cam element, spring and propelling element are sub-assembled; FIG. 6 is an illustrative view showing the screw element in the propelling mechanism of the same applicator; FIG. 7 is an operational illustrative view for illustrating the cam actions in the propelling mechanism of the applicator based on schematic diagrams of the screw element, rotary cam element, transfer cam element and propelling element; and FIG. 8 is an operational illustrative view for illustrating the cam actions in the propelling mechanism of the same applicator, following FIG. 7.

As shown in FIGS. 1 to 7, a click-type applicator according to the embodiment includes: a barrel cylinder (rear barrel) 10 storing an application liquid; a piston 12 sliding inside barrel cylinder 10; a screw shaft 14 having a male thread formed on the peripheral side thereof and engaged into the rear part of the piston 12, and is constructed to supply an application liquid inside barrel cylinder 10 to an applying part 24 at the front end of barrel cylinder 10 by clicking (propelling) a propelling element 20 in such a direction as to plunge into barrel cylinder 10 to thereby advance piston 12 via screw shaft 14.

In the aforementioned click-type applicator, a propelling mechanism A is composed of a rotary cam element 16 that is restrained from rotating relative to screw shaft 14 and has cam portions 16*a* and 16*b* formed in the front and rear, respectively, a transfer cam element 18 having a cam portion 18*a* formed in the front to mesh cam portion 16*b* in the rear of rotary cam element 16 and having projected parts 18*b* formed on the side surface thereof, the aforementioned propelling element 20 having guide slots 20*a* that guide projected parts 18*b* of transfer cam element 18 and rotating the aforementioned transfer cam element 18 by means of guide slots 20*a* and projected parts 18*b* as it moves forwards and backwards, a spring 18*c* that urges the propelling element 20 backwards and urges transfer cam element 18 forwards, and a screw element (corresponding to "fixed cam element") 22 incorporating transfer cam element 18, rotary cam element 16, spring 18*c*, screw shaft 14 and propelling element 20 and including a sleeve portion 22*a* having a backward-facing cam portion 22*c* and integrally formed therein as its rear part and a threaded part 22*b* that mates the screw shaft 14 as its front part. Here, it is possible to configure such a propelling mechanism that screw element 22 and screw shaft 14 are restrained from rotating relative to each other while rotary cam 16 and screw shaft 14 mate with each other.

Then, guide slot 20*a* of the propelling element 20 is formed tilted or angled relative to the axial direction (the front-to-rear direction of the applicator).

In the above click-type applicator, when the propelling element 20 is moved forwards in propelling mechanism A by clicking, the advancing motion is transformed into a rotary motion of transfer cam element 18 in one direction (axial forward and rightward rotational direction in the embodiment) and cam portion 18*a* of transfer cam element 18 meshes with cam portion 16*b* in the rear of rotary cam element 16 so that rotation of the transfer cam element 18 turns rotary cam element 16 to thereby advance the screw shaft 14 and hence move piston 12 forwards. On the other hand, when propelling element 20 is moved backwards by the repulsive force of spring 18*c* as clicking is released, this backward motion is transformed into a rotary motion of transfer cam element 18 in the other direction (axial forward and leftward rotational direction in the embodiment) by the function of the guide slots 20*a* and projected parts 18*b* so as to restore the original position while cam portion 16*a* at the front of rotary cam element 16 meshes with cam portion 22*c* of the sleeve portion 22, whereby the rotary motion of the rotary cam element 16 is restrained and hence the operational actions of the screw shaft 14 and piston 12 are restrained.

As shown in FIGS. 1 to 3, in the click-type applicator, applying part 24 is attached to a front end part 10*a* of barrel cylinder (rear barrel) 10 by means of a front barrel 26. Applying part 24 is not particularly specified as long as it is formed of a resinous bundle of fibers, porous material or the like that is impregnated with an application liquid and capable of applying the liquid. In the present embodiment, the rear end part of the applying part is tied up by fusing, forming a flange-like shape.

The application liquid stored in application liquid reservoir 10*b* of barrel cylinder 10 may be a cosmetic fluid, an ink for a writing implement or a chemical solution. In particular, when the application liquid is a high-viscosity cosmetic fluid (preferably, having a viscosity of 300 P·s or higher), distinct readiness of propelling performance appears.

Further, front end part 10*a* of barrel cylinder (rear barrel) 10 is stepped to be thin in diameter compared to the portion of application liquid reservoir 10*b* inside barrel cylinder 10. A removable cap 28 is fitted on front end part 10*a* of barrel cylinder 10 to cover the front barrel 26 and applying part 24. A joint 30 is arranged in the inner side of the portion where front barrel 26 is inserted into front end part 10*a* of barrel cylinder 10 so as to fix applying part 24 by nipping the flange in the rear end of the applying part 24 between the front end part of joint 30 and inner surface of front barrel 26. A pipe 32 made of SUS or resin is extended from the center hole of the joint 30 into applying part 24 so that the application liquid can flow through pipe 32 toward the tip of applying part 24.

Abutted on the front side face of the outer peripheral surface side of the stepped small-diametric portion (stepped portion 10*c*) of front end part 10*a* of the aforementioned barrel cylinder 10 is cap 28. On the other hand, the rear side face of the inner peripheral surface side of the stepped portion 10*c* fronts the interior of application liquid reservoir 10*b*. Piston 12 abuts this rear side face when the piston is advanced so that its position is constrained.

The interior of the front part of the barrel cylinder 10 forms the aforementioned application liquid reservoir 10*b* while the rear part incorporates propelling mechanism A formed of screw element 22, screw shaft 14, rotary cam element 16, transfer cam element 18, spring 18*c* and propelling element 20 and having the function of sending out the application liquid towards applying part 24 by advancing piston 12 inside the application liquid reservoir 10*b*.

Next, the structure of propelling mechanism A will be explained.

The propelling element 20 has an approximately cylindrical configuration with a closed rear end, having two extended comb tooth-like front parts each having guide slot 20*a* penetrated from the interior to exterior sides, and formed inclined with respect to the axial direction. Propelling element 20 is constructed so that when the propelling element 20 is moved forwards by the user clicking its closed rear exterior endface, the advancing motion is transformed into a rotary motion of transfer cam element 18 by the function of the guide slots 20*a* and projected parts 18*b* on the side surface of transfer cam element 18, and this rotation of the transfer cam element 18 causes rotary cam element 16 to rotate and thereby move the screw shaft 14 and hence piston 12 forwards.

Here, elastically deformable cantilevered arms are formed on the side in the rear part of propelling element 20, each of which has a projection 20*b* on the outer side. Formed on the outer peripheral surface in the center of propelling element 20 is an annular seal groove 20*c*, on which an annular elastic sealing member 34 such as an O-ring or the like, formed of rubber, elastomer or silicone, is fitted and positioned between the outer periphery of propelling element 20 and the inner periphery of sleeve portion 22*a* of screw element 22 so as to seal up between propelling element 20 and sleeve portion 22*a*.

The rotary cam element 16 has forward-facing and backward-facing cam portions 16*a* and 16*b* in the front and rear parts thereof with respect to the axial direction while a cam portion 18*a* formed at the front of the transfer cam element 18 is arranged opposing backward-facing cam portion 16*b* of the rotary cam element 16. Specifically, rotary cam element 16 has an approximately cylindrical configuration having forward-facing cam portion 16*a* formed on the front part endface and cam portion 16*b* in the halfway portion cylindrically depressed forwards in the rear part. Further, the front part of transfer cam element 18 is formed slightly smaller in diameter so as to be fitted into the cylindrical rear part of rotary cam element 16 so that cam portion 18*a* of the front part of transfer cam element 18 opposes cam portion 16*b*.

Cam portion 18*a* of transfer cam element 18 and backward-facing cam portion 16*b* of the rotary cam element 16 are formed with saw-toothed shapes so that, upon the abutment state between each other, the cam portions will mesh with each other when transfer cam element 18 turns in one direction and will easily release one from the other when transfer cam element 18 turns in the other direction. Specifically, as schematically shown in FIG. 7 below, cam portion 18*a* of transfer cam element 18 has multiple triangled saw teeth each having an inclined facet in one way (e.g., in the rightward rotational direction), whereas cam portion 16*b* of the rotary cam element 16 has multiple triangled saw teeth each having an inclined facet in the other way (e.g., in the leftward rotational direction).

As shown in FIG. 6, screw element 22 has an approximately cylindrical shape that opens to the front and rear, having a threaded part (corresponding to "female screw portion") 22*b* that is narrowed stepwise or smaller in diameter than sleeve portion 22*a*. Threaded part 22*b* is extended approximately cylindrically from the front end of sleeve portion 22*a*, and divided into two parts by bifurcating portions 22*b*1 that are cut in the axial direction so as to be elastically deformable in the radial direction. On the inner periphery of threaded part 22*b*, a female screw portion 22*b*2 having a plurality of threads (e.g., one to three threads) that can mate with screw shaft 14 is formed projectively inward. Further, flange-like vanes 22*b*3 that abut the inner peripheral surface of barrel cylinder 10 are formed on the outer periphery of threaded part 22*b*.

Formed and axially extended on the outer periphery of the sleeve portion 22*a* is a slit groove (spline groove) 22*a*2 for preventing rotation relative to barrel cylinder 10. In addition, a window portion 22*a*1 is formed at a halfway position through the length of slit groove 22*a*2.

Since threaded part 22*b* is forked by the aforementioned bifurcating portions 22*b*1, in assembling screw shaft 14, threaded part 22*b* can elastically deform so as to have screw shaft 14 attached thereto when screw shaft 14 is pushed into threaded part 22*b*. Accordingly, screw shaft 14 can be assembled without the need to turn screw shaft 14 into threaded part 22*b*, hence this enables easy and reliable attachment in the manufacturing line and can alleviate work load in a remarkable manner.

On the other hand, in the molded part of the conventional threaded part, the threaded part is formed (by injection molding or the like) without forming any parting line, so that the mold needs a rotary core for forming, resulting in being complicated, and there is no other way than making the tip of the core have a pointed blade-like sharp edge, hence there is a risk of molding trouble and the like occurring such as the tip of the core is broken during production. In contrast, since the screw element 22 of the embodiment has such a structure that threaded part 22*b* of the screw element 22 can open due to bifurcating portions (parting line) 22*b*1 to elastically deform in the radial direction, it is possible to pull out the metal core after molding threaded part 22*b* without using any rotary core, hence positively avoid the aforementioned molding trouble.

The above-described screw element 22 has threaded part 22*b* formed on the front end side with fin-like vanes 22*b*3 on the outer peripheral surface of threaded part 22*b* and also has sleeve portion 22*a* in the rear of threaded part 22*b*, which accommodates rotary cam element 16, transfer cam element 18, propelling element 20 and screw shaft 14 therein. By mating the screw shaft 14 with female screw 22*b*2 inside the threaded part 22*b*, whereby it is possible to move screw shaft 14 forwards and backwards by rotation of screw element 22. Further, it is possible to achieve compact integration and ease of sub-assembly by building transfer cam element 18, rotary cam element 16, screw shaft 14 and propelling element 20 in the sleeve of screw element 22, hence these parts can be sub-assembled and inserted into barrel cylinder 10, thus making it possible to facilitate manufacturing and positively achieve reduction in production cost.

Further, the screw element 22 has cam portion 22*c* having a plurality of inclined facets directed backwards inside sleeve portion 22*a* in the rear of threaded part 22*b*, and forward-facing cam portion 16*a* of the rotary cam element 16 is arranged opposing the backward-facing cam portion 22*c*.

Since backward-facing cam portion 22*c* is formed with the inclined facets inside sleeve portion 22*a* of screw element 22, it is possible to form a cam portion without forming separate cam elements in the propelling mechanism, hence reduce the number of parts compared to the case in which the cam elements are provided separately. Further, female screw 22*b*2 inside threaded part 22*b* mates with screw shaft 14 while vanes 22*b*3 which are partly thin-walled and arranged on the outer periphery form abutment with the inner side of the barrel cylinder 10, to thereby prevent screw element 22 from becoming open due to sinks occurring at the time of molding. Vanes 22*b*3 are assembled so as to abut the entire inner circumference of barrel cylinder 10. The number of vanes

22*b*3 is preferably two in view of meeting the requirements for the fill volume of the application liquid and for prevention against spreading. Further, formation of bifurcating portions 22*b*1 improves design flexibility of the molding die, leading to reduction in cost.

Window portion 22*a*1 of sleeve portion 22*a* is engaged with projection 20*b* of propelling element 20 so that propelling element 20 will not rotate when propelling element 20 is pressed. This makes it possible to prevent ejection failure.

Slit groove 22*a*2 receives and engages a spline projection formed inside barrel cylinder 10 so as to stop rotation of screw element 22 hence prevent rotation failure at the time of clicking. This configuration can be also applied to rotary type and slide type applicators other than click-type applicators.

Forward-facing cam portion 16*a* of rotary cam element 16 and backward-facing cam portion 22*c* inside sleeve portion 22*a* of the screw element 22 are formed with saw-toothed shapes so that, upon the abutment state between each other, the cam portions will mesh with each other when rotary cam element 16 turns in the other direction and will easily release one from the other when rotary cam element 16 turns in one direction. Specifically, as schematically shown in FIG. 7 below, forward-facing cam portion 16*a* of rotary cam element 16 has multiple triangled saw teeth each having an inclined facet in one way (e.g., in the rightward rotational direction), whereas backward-facing cam portion 22*c* inside sleeve portion 22*a* of the screw element 22 has multiple triangled saw teeth each having an inclined facet in the other way (e.g., in the leftward rotational direction).

Inside the sleeve portion 22*a*, the propelling element 20 is arranged so as to be axially movable within a fixed range with its relative rotation to screw element 22 restrained. Specifically, this limitation of relative rotation is achieved by a structure in which projections 20*b* are formed on the outer side of the elastically cantilevered deformable arms of the side part of propelling element 20 so that the projections 20*b* are fitted in window portion 22*a*1 elongated in the axial direction of sleeve portion 22*a*, movably in the forward and rearward directions, as shown in FIGS. 4 and 5. Further, projected parts 18*b* of transfer cam element 18 are fitted in guide slots 20*a* while spring 18*c* is interposed between the propelling element 20 and transfer cam element 18, making them repulsive to each other. Spring 18*c* is preferably formed of a coil spring made up of metal, resin or the like.

Next, the operational action of the above-described click-type applicator will be described with reference to FIG. 3 and FIGS. 7 and 8.

FIG. 3(*b*) and FIGS. 7(*a*) and (*b*) show a state (the original position) in which the click-type applicator is not clicked.

As shown in FIG. 7(*a*), in the click-type applicator, when the user clicks the external rear endface of propelling element 20, the propelling element 20 moves forwards, as shown in FIG. 3(*c*). Upon this, the advancing motion is transformed into a rotary motion of transfer cam element 18 (in one direction: shown by symbol F) by the function of the guide slots 20*a* and projected parts 18*b* of the transfer cam element 18. The rotational angle of transfer cam element 18 is shown in the drawing by θ and the click stroke of propelling element 20 is shown by symbol L.

The rotation of transfer cam element 18 rotates rotary cam element 16 in one direction, which causes the screw shaft 14 and hence piston 12 to move forwards. On the other hand, as the pressing force is released, propelling element 20 returns backwards and transfer cam element 18 rotates in the other direction to return to its original position.

Detailedly, as shown in FIGS. 7(*b*) to (*c*) and FIG. 8(*a*), first, when the propelling element 20 is pressed forwards, the propelling element 20 moves forwards opposing the repulsive force of the spring 18*c*. This causes projected parts 18*b* to slide along guide slots 20*a* so that the transfer cam element 18 rotates in one direction. As transfer cam element 18 turns in one direction, cam portions 18*a* and 16*b* of transfer cam element 18 and rotary cam element 16 abutting each other mesh with one another, and rotary cam element 16 rotates. Then, as shown in FIG. 7(*c*), before propelling element 20 reaches the bottom dead point, the tooth of forward-facing cam portion 16*a* of rotary cam element 16 advances through more than one pitch, climbs over the corresponding tooth of backward-facing cam portion 22*c* inside the sleeve portion 22*a*, and fits into the next tooth after one pitch when the propelling element reaches the bottom dead point, as shown in FIG. 8(*a*).

Thereby, rotation of the transfer cam element is transferred to the rotation of rotary cam element 16, which causes screw shaft 14 to rotate and advance by the function of female screw (female threads) 22*b*2 of the threaded part 22*b*. This advancement of screw shaft 14 causes piston 12 to advance inside application liquid reservoir 10*b* and send out the application liquid toward applying part 24.

On the other hand, when the pushing operation of the propelling element 20 is released, propelling element 20 moves backwards by the repulsive force of the spring 18*c* as sequentially shown in FIGS. 8(*a*) to (*c*), whereby projected part 18*b* moves along guide slot 20*a* and the transfer cam element 18 rotates in the other direction (in the direction opposite to F). The forward-facing cam portion of rotary cam element 16 and the backward-facing cam portion inside sleeve portion 22*a* of screw element 22 mesh with each other so that rotation of rotary cam element 16 is restrained and only the transfer cam rotate (see FIGS. 8(*b*) to (*c*)). Then, engagement of teeth between cam portions 18*a* and 16*b* of transfer cam element 18 and rotary cam element 16 abutting each other is released, so that each tooth advances through more than one pitch, climbs over the corresponding tooth, and fits into the next tooth after one pitch, whereby the tooth fits into the next tooth of rotary cam element 16 after one pitch without transferring any rotation of transfer cam element 18 in the other direction, to rotary cam element 16. In this case, the state of the transfer cam element turns back one pitch, or returns to the initial state shown in FIG. 8(*c*).

Now, the condition of the above rotational angle θ will be considered.

As propelling element 20 is pushed by click stroke L, transfer cam element 18 rotates by a rotational angle θ. When the rotational angle of one tooth of transfer cam element 18 and rotary cam element 16 (rear cam portion 16*b*) is B, a relation "θ>B" needs to hold.

This is because if the rotational angle θ is not greater than the rotational angle B of one tooth, each tooth of the cam portion cannot climb over the other.

Further, where the angle by which forward-facing cam portion 16*a* of rotary cam element 16 advances climbing over cam portion 22*c* of screw element 22 is denoted as C when the propelling element is fully clicked while the angle by which rotary cam element 16 further advances climbing over transfer cam element 18 when the click is released to the original position is denoted as A, θ=A+B+C, and it is possible to satisfy "θ>B" by setting the extra rotations A and C as appropriate.

If A and C are small, there occur cases where one cam tooth cannot climb over the other due to tolerance and variation of parts. If A and C are too large, the clicking stroke needs to be increased without avail, leading to inefficiency.

Consider one example, when a cam is equally divided into 16, B=360/16=22.5 deg. If A and C are set to be 5.55 deg., the angle by one click is given as θ=22.5+5.55+5.55=33.6 deg.

According to the click-type applicator of the embodiment as described above, guide slot 20*a* of propelling element 20 is formed inclined or angled relative to the axial direction, and when the propelling element 20 is moved forwards by a clicking operation, the advancing motion is transformed into a rotary motion of transfer cam element 18 in one direction by the function of the guide slots 20*a* and projected parts 18*b* so that when the cam portion of transfer cam element 18 meshes with the cam portion at the rear of rotary cam element 16, the rotation of the transfer cam element 18 causes rotary cam element 16 to rotate and thereby move the screw shaft 14 and hence piston 12 forwards. On the other hand, when propelling element 20 is moved backwards by the repulsive force of spring 18*c* by releasing the clicking operation, the backward motion is transformed into a rotary motion of transfer cam element 18 in the other direction by the function of the guide slots 20*a* and projected parts 18*b* so as to restore the original position while the cam portion at the front of rotary cam element 16 meshes with the cam portion of the sleeve portion 22*a*, whereby the rotary action of the rotary cam element 16 is restrained and hence the operational actions of the screw shaft 14 and piston 12 are restrained. Accordingly, the force of the clicking operation of propelling element 20 can be transferred to the pressing force of piston 12 without any loss, and hence it is possible to make the operating sensation lighter while preventing the loss of clicking force when a high-viscosity content is propelled.

In addition, since sleeve portion 22*a* having backward-facing cam portion 22*c* integrally formed therein is provided as the rear part of screw element 22, or because no separate cam element is provided, it is possible to reduce the number of parts and facilitate manufacturing, compared to the conventional products using a separate cam element (e.g., Japanese Patent Application Laid-open 2001-232273).

When propelling element 20 is pressed forwards, the propelling element 20 moves forwards opposing the repulsive force of the spring 18*c*, which causes projected parts 18*b* to slide along guide slots 20*a* so that the transfer cam element 18 rotates in one direction. Rotation of transfer cam element 18 in one direction is transferred to rotation of rotary cam element 16 as the cam portions of transfer cam element 18 and rotary cam element 16 opposing each other mesh with one another while engagement between the forward-facing cam portion of rotary cam element 16 and the cam portion of the backward-facing cam portion inside the sleeve portion 22*a* is released from each other, and this rotation of rotary cam element 16 causes screw shaft 14 to rotate and advance by the function of the female screw of the threaded part 22*b*. When the pushing operation of the propelling element 20 is released, propelling element 20 moves backwards by the repulsive force of the spring 18*c*, whereby projected parts 18*b* move along guide slots 20*a* and the transfer cam element 18 rotates in the other direction, and engagement between the cam portions of transfer cam element 18 and rotary cam element 16 abutting each other is released while the forward-facing cam portion of rotary cam element 16 and the backward-facing cam portion inside sleeve portion 22*a* of screw element 22 become engaged with each other, whereby rotation of transfer cam element 18 in the other direction will not be transferred to rotary cam element 16. Thus, it is possible to push out piston 12 smoothly as clicking operations of propelling element 20 are repeated.

When the tooth pitch of cam portion 18*a* of transfer cam element 18 and backward-facing cam portion 16*b* of rotary cam element 16 and the tooth pitch of forward-facing cam portion 16*a* of the rotary cam element 16 and backward-facing cam portion 22*c* inside sleeve portion 22*a* of the screw element 22 are made equal to each other while the teeth of backward-facing cam portion 16*b* and the teeth of forward-facing cam portion 16*a* of rotary cam element 16 are formed out of phase, the cam teeth of forward-facing cam portion 16*a* of rotary cam element 16 are fitted in the cam teeth of cam portion 22*c* of sleeve portion 22*a* before clicking operation of propelling element 20 while cam portion 18*a* of transfer cam element 18 and cam teeth of backward-facing cam portion 16*b* are formed out of phase during clicking operation of propelling element 20, so that transfer cam element 18 rotates as propelling element 20 moves forwards.

Then, when rotary cam element 16 is urged and pressed forwards by spring 18*c* at the time of click release of propelling element 20, forward-facing cam portion 16*a* of rotary cam element 16 and cam portion 22*c* of sleeve portion 22*a* positively engage with each other, so that it is possible to reliably prevent rotary cam element 16 from rotating in reverse.

Further, when an annular seal member (elastic member) 34 is circumferentially positioned between the outer periphery of propelling element 20 and the inner periphery of sleeve portion 22*a* of screw element 22, the annular seal member 34 can assure airtightness from propelling element 20 to the rear, reliably prevent the content from drying and being deteriorated and produce other excellent effect.

Here, in the present invention, the application liquid stored in application liquid reservoir 10*b* of barrel cylinder 10 may be a cosmetic fluid, ink for writing implements, chemical solution. In particular, when the application liquid is a high-viscosity cosmetic fluid, distinct readiness of propelling performance appears compared to conventional configurations. To confirm the effect, a fixed amount of a lip-glow cosmetic product on the market was filled into a container of a conventional product and the application liquid reservoir of the click-type applicator of the present invention, and the usability after leaving them for 24 hours under different temperature conditions was evaluated. The evaluation result is shown in the following table.

TABLE 1

| | Product Left Temperature | | | |
|---|---|---|---|---|
| | 25° C. | 10° C. | 5° C. | 0° C. |
| (Lip-Gloss Liquid Viscosity *1) | 30 Pa · s | 212 Pa · s | 354 Pa · s | — |
| Product of Invention | ○ | ○ | ○ | ○ |
| Comparative Example (Conventional Product) | ○ | ○ | X | X |

*1: A product of TOKI SANGYO CO., LTD. TVE Viscosimeter, 3° Cone, 2 sec−1. At 0° C., it was impossible to perform viscosity measurement in the condition.
○: Usable (could be clicked)
X: Unusable (could not be clicked)

As understood from the table, it was impossible to perform a clicking operation for the conventional product at 5° C. to 0° C., whereas it was possible to perform clicking operations for the product of the invention at 5° C. to 0° C., or the product was usable. That is, remarkable effect of the present invention could be confirmed.

The present invention should not be limited to the click-type writing implement of the above embodiment, various changes can be made within the scope of the present invention. Though the present embodiment was illustrated taking a click-type as a writing implement, the present invention can also be applied to a rotary propelling type writing implement in which the piston is advanced by rotating the propelling element relative to the barrel cylinder.

INDUSTRIAL APPLICABILITY

The click-type applicator of the present invention can be applied to applicators for applying high viscosity application liquids of cosmetics, chemicals and ink.

DESCRIPTION OF REFERENCE NUMERALS

10 barrel cylinder (rear barrel)
10*a* front end part of barrel cylinder
10*b* application liquid reservoir
10*c* stepped portion
12 piston
14 screw shaft
16 rotary cam element
16*a* forward-facing cam portion (cam portion at the front)
16*b* backward-facing cam portion (cam portion at the rear)
18 transfer cam element
18*a* cam portion
18*b* projected part
18*c* spring
20 propelling element
20*a* guide slot
20*b* projection
20*c* seal groove
22 screw element
22*a* sleeve portion
22*a*1 window portion
22*a*2 slit groove
22*b* threaded part
22*b*1 bifurcating portion
22*b*2 female screw thread
22*b*3 vane
22*c* cam portion
24 application liquid
26 front barrel
28 cap
30 joint
32 pipe
34 sealing member
A propelling mechanism

The invention claimed is:

1. A click-type applicator storing an application liquid in a barrel cylinder, wherein a screw shaft is engaged with the rear part of a piston that slides inside the barrel cylinder, the piston is advanced by means of the screw shaft by a propelling operation on a propelling mechanism so as to supply the application liquid inside the barrel cylinder to an applying part at the front end of the barrel cylinder, wherein the propelling mechanism comprises:

a rotary cam element having cam portions formed in the front and rear thereof;

a transfer cam element having a cam portion at the front thereof to mesh the cam portion at the rear of the rotary cam element and having a projected part formed on the side surface thereof;

a propelling element, in which a guide slot that guides the projected part of the transfer cam element is formed inclined relative to the axial direction, and which is restrained from rotating relative to the barrel cylinder;

a spring that urges the propelling element backwards and urges the transfer cam element forwards; and, a fixed cam element formed with a backward-facing cam portion and restrained from rotating relative to the barrel cylinder, one of the rotary cam element and the fixed cam element is formed with an engagement structure that is restrained from rotating relative to the screw shaft while the other is formed with a threaded part that mates with the screw shaft so that rotation of the rotary cam element is transformed into a motion that advances the screw shaft relative to the barrel cylinder by the function of cooperation of the engagement structure, the threaded part and the screw shaft, so as to advance the piston, when the propelling element is moved forwards by a clicking operation, the advancing motion is transformed into a rotary motion of the transfer cam element in one direction by the function of the guide slot and projected part so that when the cam portion of the transfer cam element meshes with the cam portion at the rear of the rotary cam element, the rotation of the transfer cam element causes the rotary cam element to rotate and thereby move the screw shaft and hence the piston forwards, when the clicking operation is released after the propelling element has been once advanced by the clicking operation, the propelling element moves backwards due to the repulsive force of the spring, and the backward motion of the propelling element is transformed into a rotary motion of the transfer cam element in the other direction by the function of the guide slot and the projected part so as to restore the original position while the cam portion at the front of the rotary cam element meshes with the cam portion of the fixed cam element, whereby the rotary motion of the rotary cam element is restrained and hence the operational actions of the screw shaft and the piston are restrained, the fixed cam element has a sleeve portion that extends backwards, and the propelling mechanism is configured to arrange the rotary cam element, the transfer cam element, the propelling element and the spring within the sleeve portion of the fixed cam element, the fixed cam element having the sleeve portion is formed as a single piece, the backward-facing cam portion is formed annularly, the backward-facing cam portion is configured in such a manner that the backward-facing cam portion does not move relative to the fixed cam element, and the application liquid is a high-viscosity cosmetic fluid.

2. The click-type applicator according to claim 1, wherein the screw shaft has a variant shape from which part of the periphery is cut away in a cross-sectional view, the rotary cam element is formed with a variant hole that passes the screw shaft therethrough so as to allow the axial movement, and restrain the relative rotation, of the screw shaft, the cam portion of the transfer cam element and the backward-facing cam portion of the rotary cam element are formed with saw-toothed shapes so that, upon the abutment state between each other, the cam portions will mesh with each other when the transfer cam element turns in one direction and will easily release one from the other when the transfer cam element turns in the other direction, the fixed cam element is so formed that a female screw that mates with a male thread of the screw shaft is formed in the center axis thereof and the forward-facing cam portion of the rotary cam element is arranged opposing the backward-facing cam portion thereof, the forward-facing cam portion of the rotary cam element and the backward-facing cam portion of the fixed cam element are formed with saw-toothed shapes so that, upon the abutment state between each other, the cam portions will mesh with each other when the rotary cam element turns in the other direction and will easily release one from the other when the rotary cam element turns in one direction, the propelling element is arranged so as to be axially movable within a fixed range with its relative rotation to the fixed cam element restrained, when the propelling element is pressed forwards, the propelling element moves forwards opposing the repulsive force of the spring, which causes the projected part to slide along the guide slot so that the transfer cam element rotates in one direction, as the transfer cam element turns in one direction, the cam portions of the transfer cam element and the rotary cam element abutting each other mesh with one another while engagement between the forward-facing cam portion of the rotary cam element and the backward-facing cam portion of the fixed cam element is released from each other, whereby rotation of the transfer cam element is transferred to the rotary cam element, which causes the screw shaft to rotate and advance by the function of the female screw of the fixed cam element, when the pushing operation of the propelling element is released, the propelling element moves backwards by the repulsive force of the spring, whereby the projected part moves along the guide slot and the transfer cam element rotates in the opposite direction, and engagement of teeth between the cam portions of the transfer cam element and the rotary cam element abutting each other is released while the forward-facing cam portion of the rotary cam element and the backward-facing cam portion of the fixed cam element become engaged with each other, whereby rotation of the transfer cam element in the opposite direction will not be transferred to the rotary cam element.

3. The click-type applicator according to claim 1, wherein the screw shaft has a variant shape from which part of the periphery is cut away in a cross-sectional view, the rotary cam element is formed with a variant hole that passes the screw shaft therethrough so as to allow the axial movement, and restrain the relative rotation, of the screw shaft, the fixed cam element is approximately cylindrical and has a front part, projected forward and having a female screw that mates with the male thread of the screw shaft, formed in the center axis, and, the female screw portion is formed with cutout from the front end to the rear so that the female screw portion will elastically deform and become larger in diameter as a whole, so as to spread due to the cutout when the screw shaft is attached thereto.

4. The click-type applicator according to claim 1, wherein the guide slot of the propelling element is formed such that the rotatable range of the transfer cam element in a circumferential direction, limited by engagement of the projection with the guide slot, is greater than each of the tooth pitch of the transfer cam element and the backward-facing cam portion of the rotary cam element and the tooth pitch of the cam portions of the forward-facing cam portion of the rotary cam element and the backward-facing cam portion of the fixed cam element.

5. The click-type applicator according to claim 1, wherein the tooth pitch of the cam portion of the transfer cam element and the backward-facing cam portion of the rotary cam element is equal to the tooth pitch of the cam portion of the forward-facing cam portion of the rotary cam element and the backward-facing cam portion of the fixed cam element while the teeth of the backward-facing cam portion and the teeth of the forward-facing cam portion of the rotary cam element are out of phase.

6. The click-type applicator according to Claim 1, wherein an annular elastic member is disposed circumferentially between the outer periphery of the propelling element and the inner periphery of the sleeve portion of the fixed cam element.

7. An applicator incorporating a reservoir for storing an application liquid, a piston that slides inside the reservoir and a screw shaft having a male thread formed on the peripheral surface thereof, in a barrel cylinder so as to supply the application liquid from the reservoir to an applying part at the front end of the barrel cylinder, including: in the rear of the reservoir of the barrel cylinder, a rotary cam element restrained from rotating relative to the screw shaft;

a transfer element disposed at the rear end for rotating the rotary cam element by operating a propelling element; and a screw element formed with a threaded part mating with the screw shaft, wherein the threaded part of the screw element has a structure that is elastically deformable in radial direction and can be spread with respect to a parting line, the application liquid stored in the reservoir is supplied to the applying part by propelling the piston as the rotary cam element is rotated by actuating the propelling element, the screw element has a sleeve portion in the rear of the threaded part, and the sleeve portion is configured to accommodate the rotary cam element, transfer element, propelling element and screw shaft therein, the screw element has a threaded part on the front end side thereof, the screw element has a cam portion directed backwards inside the sleeve portion in the rear of the threaded part, and a forward-facing cam portion of the rotary cam element is arranged opposing the backward-facing cam portion, the forward-facing cam portion of the rotary cam element and the backward-facing cam portion inside the sleeve portion of the screw element are formed with saw-toothed shapes so that, upon the abutment state between each other, the cam portions will mesh with each other when the rotary cam element turns in the other direction and will easily release one from the other when the rotary cam element turns in one direction, the screw element having the sleeve portion is formed as a single piece, the backward-facing cam portion is formed annularly, the backward-facing cam portion is configured in such a manner that the backward-facing cam portion does not move relative to the screw element, and the application liquid is a high-viscosity cosmetic fluid.

8. The applicator according to claim 7, wherein the screw element has fin-like vanes on the outer peripheral surface of the threaded part, and the screw shaft is mated with the female screw thread inside the threaded part.

9. The applicator according to claim 7, wherein the sleeve portion has a slit groove for preventing rotation relative to the barrel cylinder, the slit groove axially extending on the sleeve portion.

* * * * *